US008656681B1

(12) United States Patent
Iannelli

(10) Patent No.: US 8,656,681 B1
(45) Date of Patent: Feb. 25, 2014

(54) METHOD FOR SECURING A PANEL OVER A GAP IN AN EXTERIOR PORTION OF A BUILDING

(71) Applicant: Anthony M. Iannelli, Cincinnati, OH (US)

(72) Inventor: Anthony M. Iannelli, Cincinnati, OH (US)

( * ) Notice: Subject to any disclaimer, the term of this patent is extended or adjusted under 35 U.S.C. 154(b) by 0 days.

(21) Appl. No.: 13/970,635

(22) Filed: Aug. 20, 2013

Related U.S. Application Data

(62) Division of application No. 09/635,281, filed on Aug. 9, 2000.

(51) Int. Cl.
*E04D 13/158* (2006.01)

(52) U.S. Cl.
CPC ..... *E04D 13/158* (2013.01)
USPC ..... 52/745.21; 52/747.1; 52/94

(58) Field of Classification Search
CPC ..... E04B 7/06; E04D 13/158
USPC ..... 52/92.2, 92.3, 93.1, 93.2, 94, 95, 702, 52/712, 714, 745.21, 747.1, 747.11, 283, 52/289, 376; 403/232.1
See application file for complete search history.

(56) References Cited

U.S. PATENT DOCUMENTS 3,293,808 A * 12/1966 Duncan ..... 52/92.2
3,344,566 A * 10/1967 Miles et al. ..... 52/94
3,488,899 A * 1/1970 Radtke et al. ..... 52/14
4,998,390 A * 3/1991 Glover et al. ..... 52/95
5,699,639 A * 12/1997 Fernandez ..... 52/707

* cited by examiner

*Primary Examiner* — Michael Safavi
(74) *Attorney, Agent, or Firm* — Frost Brown Todd LLC

(57) ABSTRACT

A pair of relatively spaced apart frame-engaging plates are provided on the anchoring end of the bracket. An elongated body extends downwardly from the anchoring end and spans a gap between the roof frame member to which the anchoring end is attached and the exterior brick. An elongated opening extends between panel facing edge portions of the elongated body and into an insert receiving recess. A frieze panel adapted to cover the gap between the roof frame member and the brick is mounted on the bracket by nailing it to a wooden insert mounted in the recess.

15 Claims, 7 Drawing Sheets

METHOD FOR SECURING A PANEL OVER A GAP IN AN EXTERIOR PORTION OF A BUILDING

CROSS REFERENCE TO RELATED APPLICATIONS

This application is a divisional application of U.S. patent application Ser. No. 09/635,281, filed Aug. 9, 2000, the disclosure of which is incorporated by reference herein in its entirety.

BACKGROUND OF THE INVENTION

This invention relates to brackets for use with wooden frame members of buildings and more particularly to brackets for connecting a frieze or other cover panel to such frame members.

In the past, relatively labor intensive assemblies known as chicken ladders were installed in the gap extending between the eave or roof overhang and the upper course of brick or other material defining the outer wall of the building. The chicken ladder was typically fashioned onsite and involved some risk of injury because the 1×6 or 1×8 lumber employed in the assembly was heavy and unwieldy. It also required a relatively large amount of time to piece together and install. Thus, the present inventor was confronted with the problem of providing a relatively safe, inexpensive and easily installable device that was suitable for use in several different structures and that would hold the cover member securely to underlying frame members of the building.

SUMMARY OF THE INVENTION

The present bracket is adapted to be mounted on a frame member and to secure a panel over a gap in an exterior portion of a building. The subject bracket basically comprises an anchoring end adapted to be secured to the frame member; an elongated body defining a recess, said body having at least one panel-facing portion and a length substantially sufficient to span the gap in the exterior portion of the building; and at least one opening in the body adjacent to said at least one panel-facing portion, said opening extending into the recess.

DETAILED DESCRIPTION OF THE PREFERRED EMBODIMENTS

Figure 1:
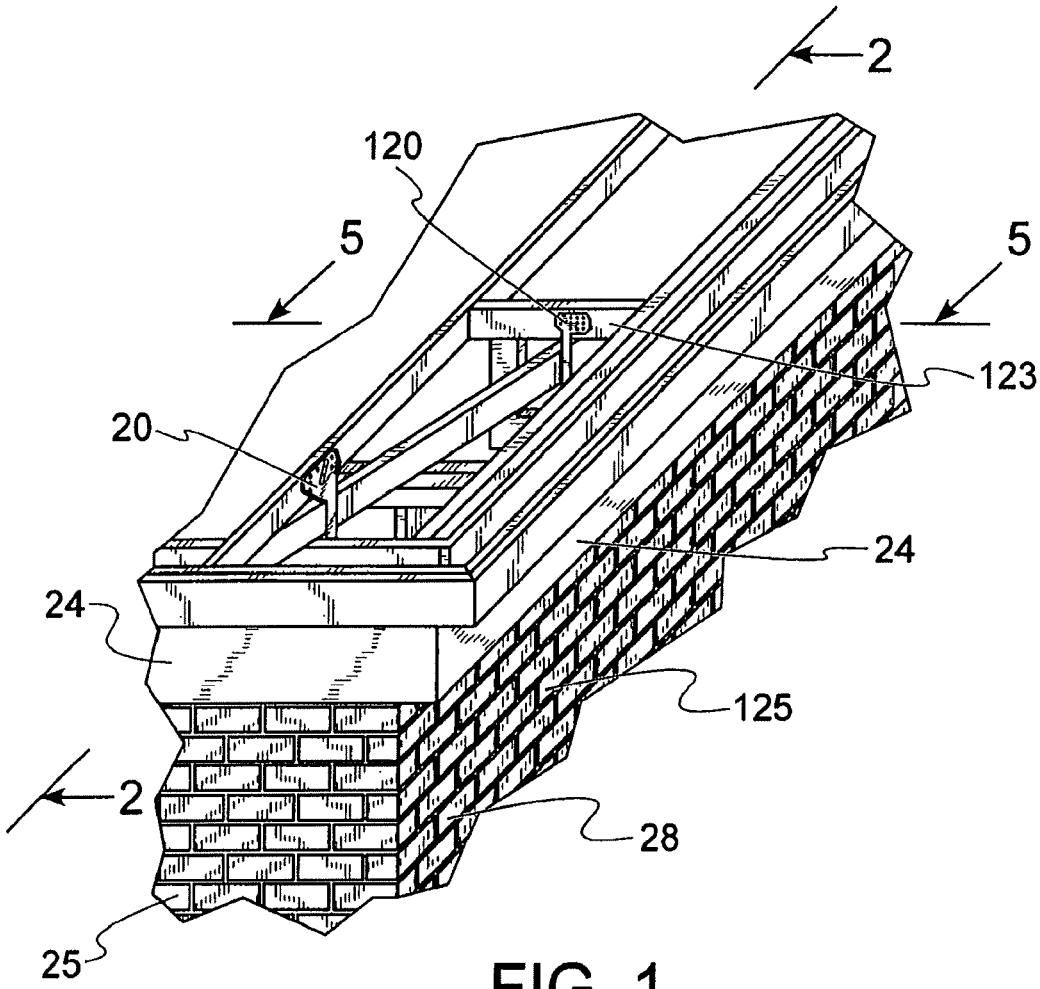
FIG. 1 is a fragmentary perspective view of roof frame members and upper adjoining wall portions of a building.
Figure 2:
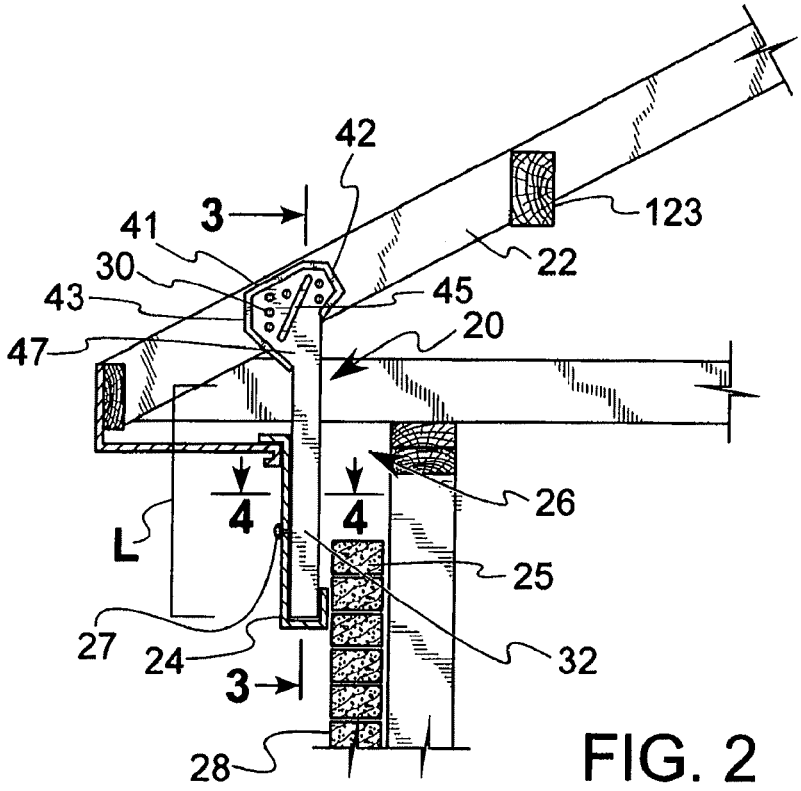
FIG. 2 is an enlarged vertical sectional view taken along line 2-2 of FIG. 1 and particularly illustrates a first preferred embodiment of the present frieze bracket in an operative position.
Figure 3:
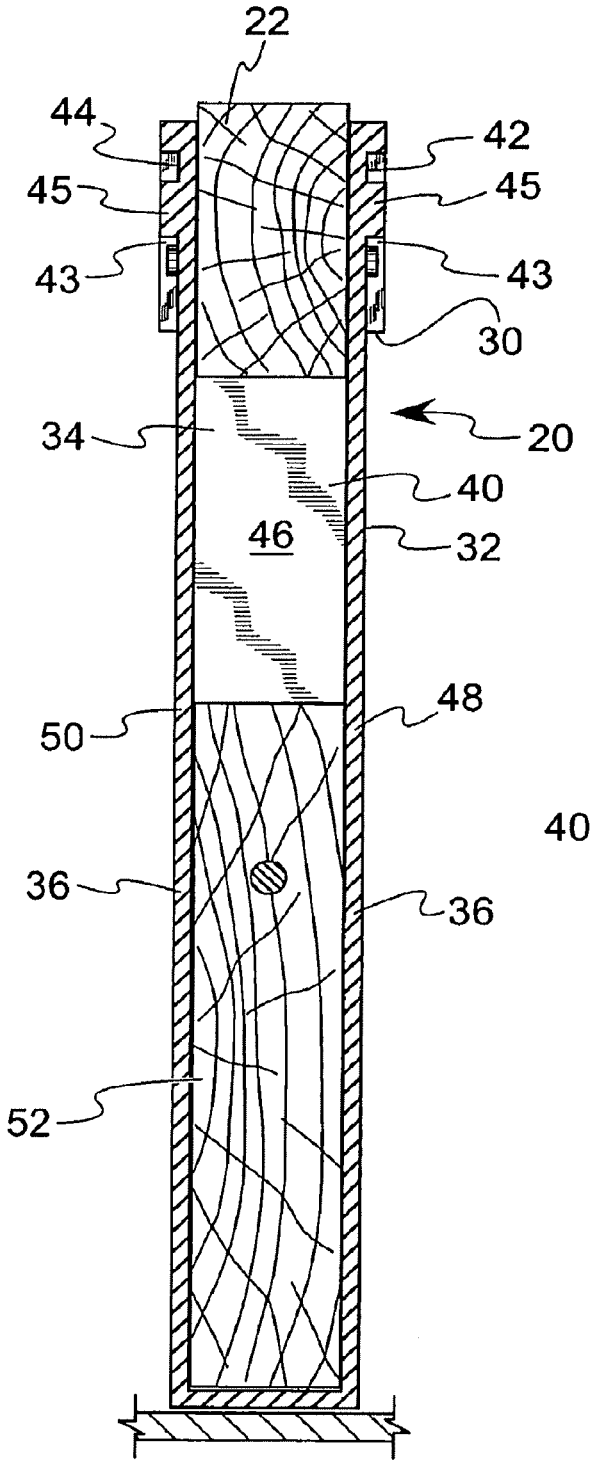
FIG. 3 is an enlarged vertical sectional view taken along line 3-3 of FIG. 2 and particularly illustrates the channel-form construction of the subject bracket.
Figure 4:
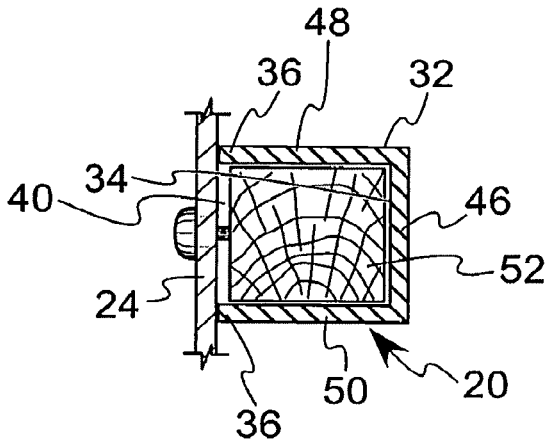
FIG. 4 is an enlarged horizontal sectional view taken along line 4-4 of FIG. 2 and particularly illustrates the insert engaging body portion of the bracket.

As illustrated in FIGS. 2-4, the present bracket, generally designated 20, is adapted to be mounted on a frame member 22 and to secure a panel 24 over a gap 26 in an exterior portion of a building 28 (FIG. 1). The bracket 20 basically comprises an anchoring end 30 adapted to be secured to the frame member 22, an elongated body 32 defining a recess 34 and having at least one panel-facing portion 36 and a length L substantially sufficient to span the gap 26 in the exterior portion of the building 28, and at least one opening 40 in the body 32 adjacent to said at least one panel-facing portion 36, said opening 40 extending into the recess 34.

As further illustrated in FIGS. 2 and 3, in the first embodiment 20 of the present bracket, the following additional features are preferred. The anchoring end 30 of the bracket is disposed in fixed relation to the body 32. The anchoring end 30 comprises a pair of relatively spaced apart plates 42, 44 which are disposed to engage opposing sides of an inclined roof truss or chord 22. One of the upper edges 41 of each of the plates 42, 44 is inclined relative to the body to approximately the same degree as the roof truss 22 is inclined to a vertical plane. Each of the plates 42, 44 is provided with laterally outwardly extending edge flanges 43 and with a transversely extending rib 45. In addition, each of the plates 42, 44 is formed with a transition fin 47 extending from the plate 42, 44 to the adjoining side wall 36. The edge flanges 43 and the rib 45 strengthen the plates 42, 44, and the transition fin 47 helps to fix the position of the body 32 relative to the anchoring end 30. In this manner, the bracket 10 is strengthened against the impact generated by driving a nail 27 or other fastener through the exterior panel 24 and into the fastener receiving insert 52 in the body 32. The length L of the body 32 spans the gap 26 between the roof truss 22 and an upper layer 25 of exterior brick and overlaps additional layers of brick.

As illustrated in FIGS. 2 and 3, the body 32 preferably comprises a web portion 46 and opposing side walls 48, 50 projecting from the web portion 46. The panel facing portions 36 are defined by free edges of the opposing side walls 48, 50. Each of the opposing side walls 48, 50 is continuous and substantially coplanar with one of the relatively spaced apart plates 42, 44 comprising the anchoring end 30. The recess 34 extends substantially the entire length of the body 32, and is adapted to receive an insert 52 formed from wood or other fastener-receiving material. The insert 52 is glued to the interior surfaces of the web portion 46 and side walls 48, 50 of the bracket body. Alternatively, a plurality of projections or indentations may be formed in the side walls 48, 50 of the body by an awl or other pointed object to hold the insert 52 in place. The opening 40 extends between the panel facing portions 36 approximately the entire length of the body 32.

Preferably, one of the brackets 20 is affixed to each, every other or every third frame member 22, and the frieze panel 24 of vinyl or aluminum siding or other suitable material is secured to the elongated body 32 of each bracket 20 by nails 27 or other fasteners extending through the opening 40 and into the wooden insert 52 mounted in the recess 34. In this manner, the gap 26 extending downwardly and laterally from the frame members 22 of the roof to the upper layer of exterior brick 25 is covered by the panels 24 (FIG. 1).

Figure 5:
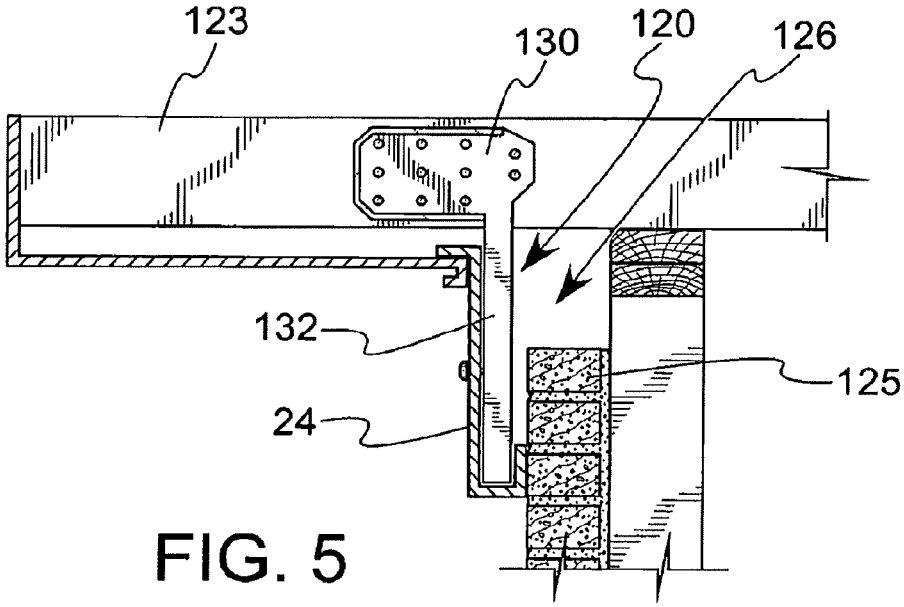
FIG. 5 is an enlarged vertical sectional view taken along line 5-5 of FIG. 1 and particularly illustrates a rake line profile of a second preferred embodiment of the present bracket.
Figure 6:
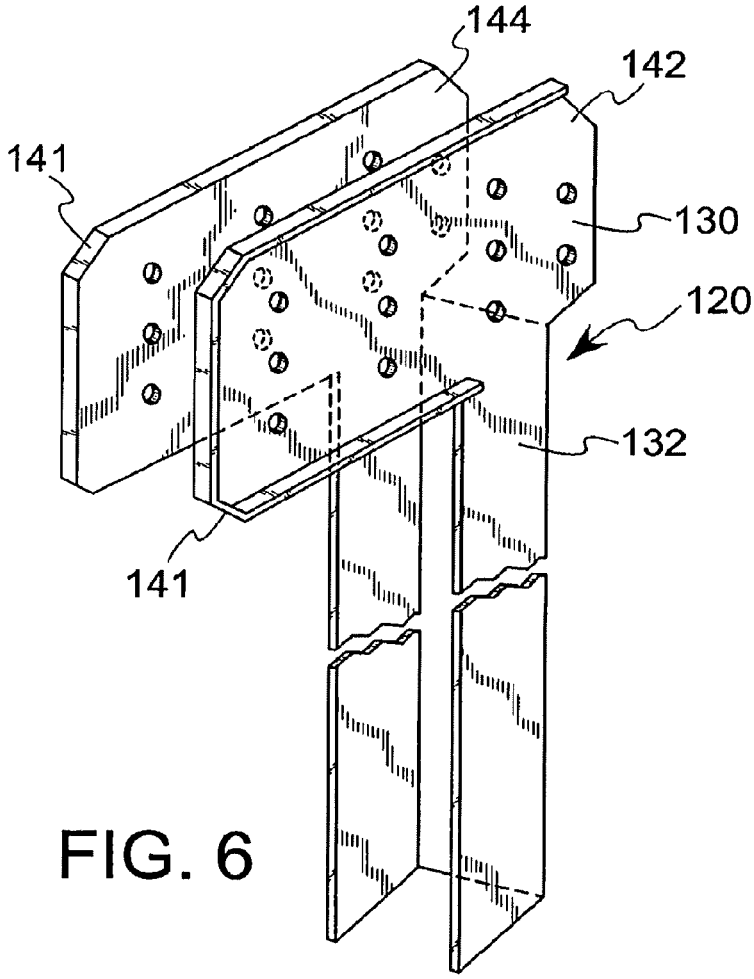
FIG. 6 is an enlarged perspective view of the bracket shown in FIG. 5.

As illustrated in FIGS. 5 and 6, the anchoring end 130 of a second preferred embodiment 120 of the present bracket is adapted to be nailed or otherwise secured to a horizontally extending fly rafter 123, rather than to the inclined truss or chord 22 shown in FIG. 2. Each of the spaced apart, frame-engaging plates 142, 144 defining the anchoring end 130 is generally rectangular in shape and is provided with laterally outwardly projecting outer edges 141. Since the fly rafter 123 is typically closer to the gap 126 between said frame member 23 and the top layer of brick 125 than the inclined truss member 22 shown in FIG. 2, the body 132 of the bracket 120 is shorter than the body 32 of the bracket 20. Otherwise, the body portions 32, 132 are substantially similar.

Figure 7:
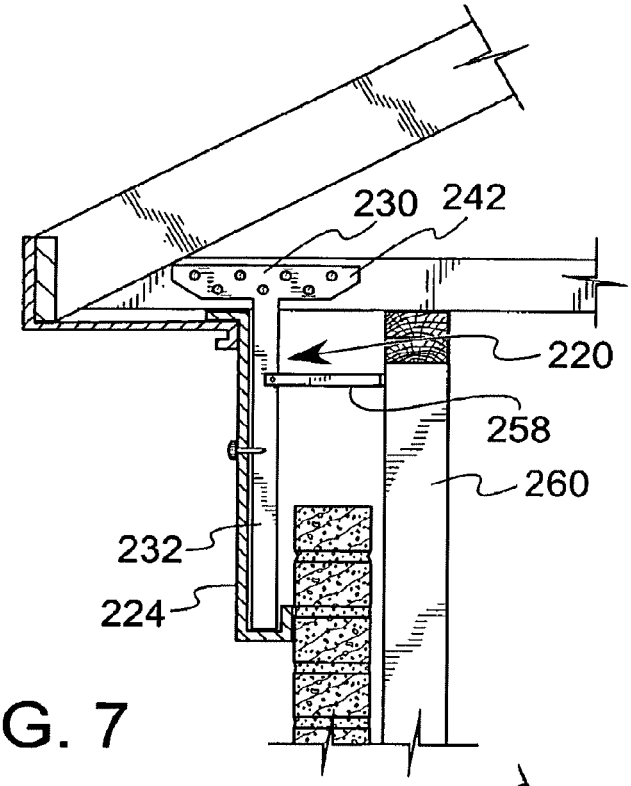
FIG. 7 is a view similar to FIG. 2 and particularly illustrates a third embodiment of the present bracket.

As illustrated in FIG. 7, a pair of relatively opposing frame-engaging plates 242 (only one is shown) comprising the anchoring end 230 and the body portion 232 form a generally T-shaped third embodiment 220 of the present bracket. A brace 258 extends between and is fastened to an upper portion of the body 232 and the stud wall 260.

Figure 8:
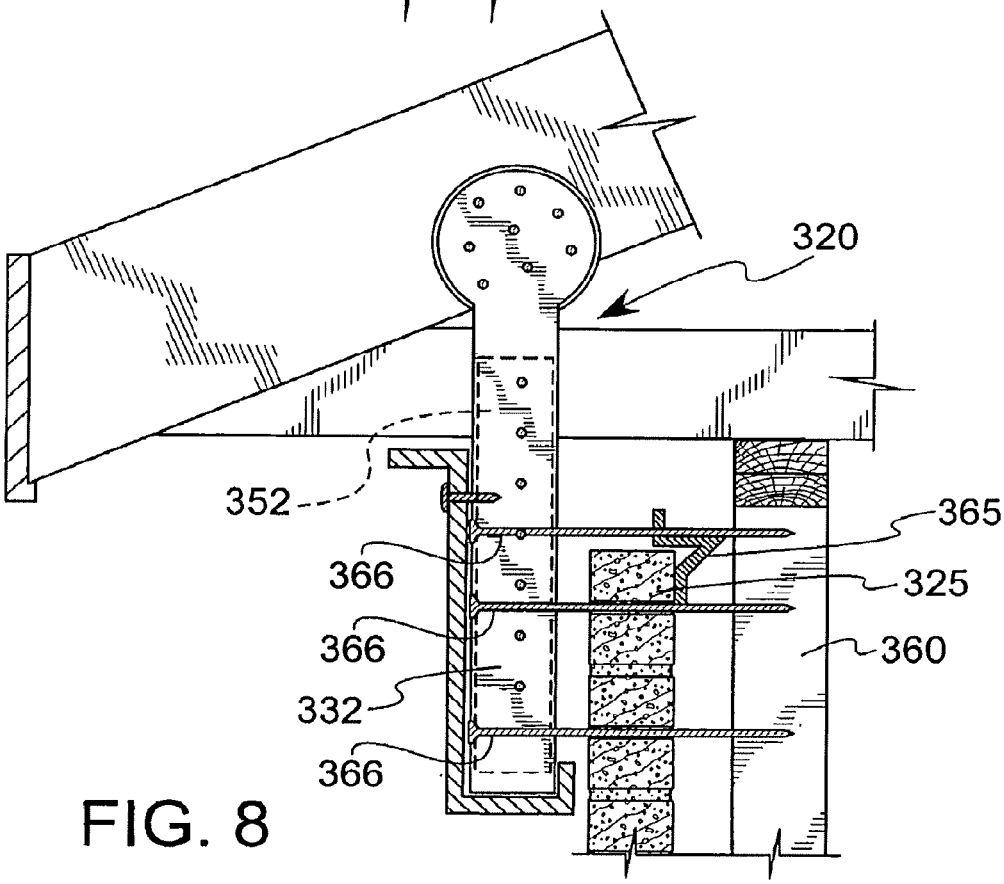
FIG. 8 is a view similar to FIG. 2 and particularly illustrates a fourth embodiment of the present bracket.

As illustrated in FIG. 8, a fourth embodiment 320 of the present bracket is provided with one or more elongated nails, bolts, screws or other fasteners 366 which are driven or otherwise arranged so as to extend through the fastener receiving insert 352 in the bracket body 332, through the mortared joints between the exterior bricks and 325 and into the stud wall 360. In this manner, the bracket 320 may be more thoroughly secured in the desired position. A spacer 368 may be mounted on the fastener 366 and positioned between the brick layer 325 and the stud wall 360.

Figure 9:
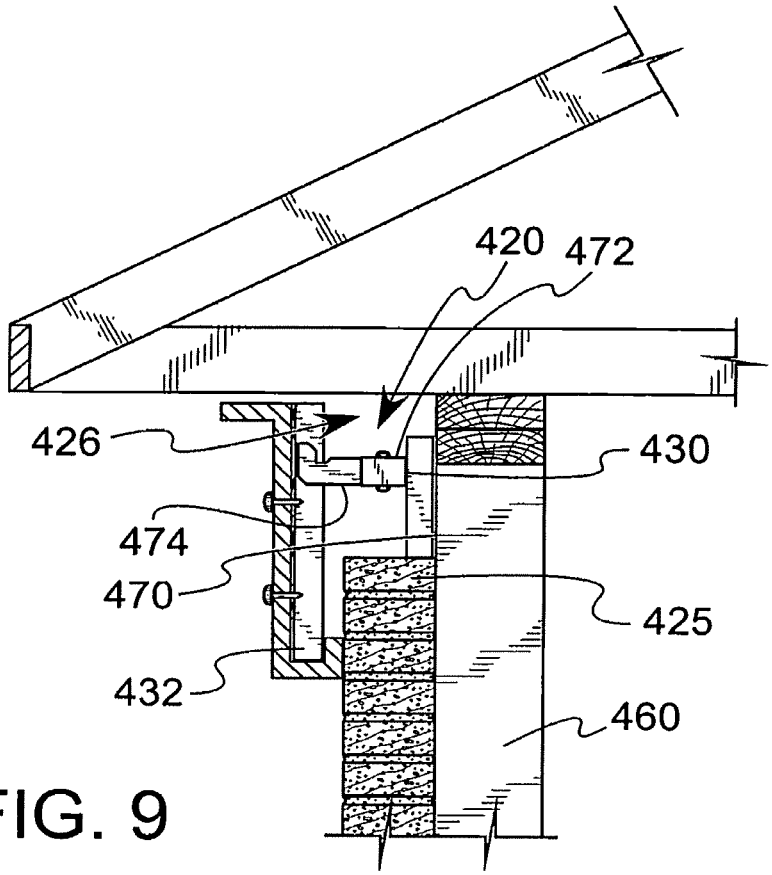
FIG. 9 is a view similar to FIG. 2 and particularly illustrates a fifth embodiment of the present bracket.
Figure 10:
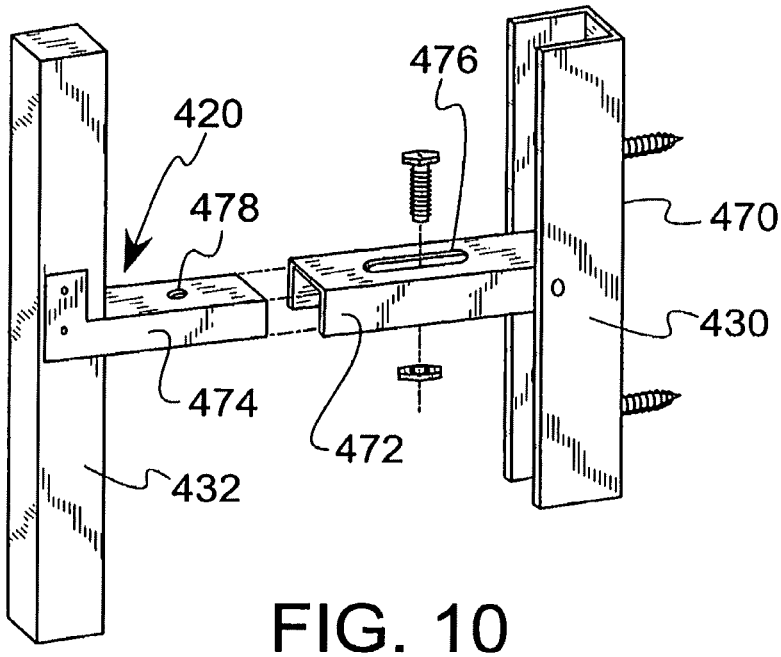
FIG. 10 is a perspective view of the fifth embodiment of the present bracket shown in FIG. 9.

As illustrated in FIGS. 9 and 10, the anchoring end 430 of a fifth embodiment 420 of the present frieze bracket comprises a frame-engaging face 470 and a first transverse mounting arm 472 extending from the face 470. A second transverse mounting arm 474 extends from the elongated body 432 of the bracket 420. The first and second transverse mounting arms 472, 474 are adapted for adjustable telescoping engagement with one another. A fastener receiving slot 476 is formed in the first mounting arm 472, and a fastener-receiving bore 478 is formed in the second mounting arm 474. In this manner, the space between the frame-engaging face 470 and the body 432 may be adjusted and maintained so that the frame-engaging face 470 may be secured to the stud wall 460, and the elongated body 432 may span the gap 426 and abut against the exterior brick layer 425.

Figure 11:
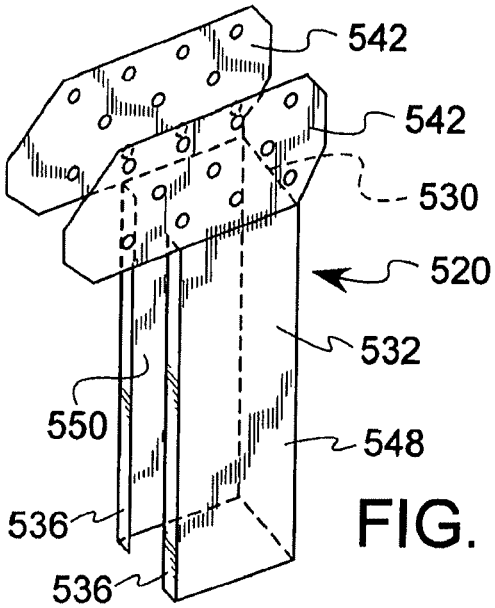
FIG. 11 is a perspective view of a sixth embodiment of the present bracket.
Figure 12:
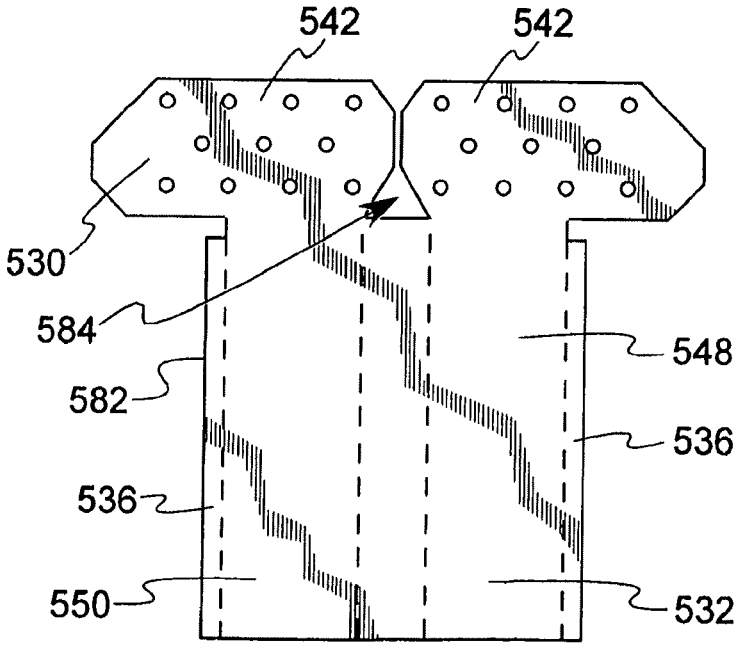
FIG. 12 is an elevational view of a planar, unitary work piece from which the bracket shown in FIG. 11 is formed.

As illustrated in FIGS. 11 and 12, the bracket 520 may be formed from a unitary sheet 582 of malleable metal, such as steel or aluminum alloy. The frame-engaging plates 542 of the anchoring end 530 are separated from each other by a cut out section 584. Preferably, the cut out section 584 is minimized so as to more closely approximate an overall T-shaped configuration in the bracket 520. The relatively spaced apart free edges defining the panel-facing portions 536 of the elongated body 532 are turned towards each other approximately perpendicularly to the opposing side walls 548, 550.

While several preferred embodiments of the present frieze bracket have been illustrated and described in some detail, this disclosure is not intended to limit unduly the spirit of the invention or the scope of the following claims.

I claim:

1. A method for securing a panel over a gap in an exterior portion of a building comprising:

providing a bracket, a fastener receiving insert, and a panel, attaching the bracket to a frame member of the building, inserting the fastener receiving insert into the recess of the bracket, and attaching the panel to the fastener receiving insert so the panel covers, at least partially, the gap in the exterior portion of a building;

wherein the gap is disposed below the frame member;

wherein the bracket comprises:

an anchoring plate having a frame-engaging face;

an elongated body depending from the anchoring plate and defining a recess of generally uniform width, said elongated body having a panel-facing portion disposed outwardly of the recess, wherein the elongated body comprises a web portion and a pair of opposing side walls projecting from the web portion, said web portion and opposing side walls defining the recess;

an opening into the elongated body adjacent to the panel-facing portion, said opening extending into the recess in said elongated body; and wherein the anchoring plate is wider than the side walls;

wherein the elongated body has a long axis defined by the direction of its longest dimension, wherein the recess has a long axis defined by the direction of its longest dimension, wherein the web has a long axis defined by the direction of its longest dimension;

wherein the plane of the frame-engaging face of the anchoring plate, the long axis of the elongated body, the long axis of the recess, and the long axis of the web portion are all parallel.

2. The method of claim 1, wherein the anchoring plate is disposed in fixed relation to the elongated body.

3. The method of claim 2, wherein the bracket comprises a second anchoring plate, each of said anchoring plates having a frame-engaging face.

4. The method of claim 1, wherein the fastener receiving insert comprises wood.

5. The method of claim 3, wherein each of the opposing side walls is continuous with a respective one of the anchoring plates.

6. The method of claim 3, wherein each of the side walls is substantially coplanar with a respective one of the anchoring plates.

7. The method of claim 3, wherein the panel-facing portion of the elongated body comprises a pair of relatively spaced apart free edges on the opposing side walls of said body.

8. The method of claim 7, wherein the pair or relatively spaced apart free edges are turned towards each other approximately perpendicularly to the opposing side walls.

9. The method of claim 3, wherein the bracket further comprises a generally straight brace adapted to be secured at one end to the building and at an opposing end to the elongated body.

10. The method of claim 7, wherein the recess extends substantially the entire length of the elongated body.

11. The method of claim 7, wherein the elongated body is open at least one end thereof.

12. The method of claim 3, wherein the recess in the elongated body is adapted to enclose a fastener receiving insert.

13. The method of claim 3, wherein the anchoring plates define an upper end of the bracket.

14. The method of claim 3, wherein the anchoring plates are substantially wider than the side walls of the elongated body.

15. The method of claim 3, wherein each of the anchoring plates is formed with an edge flange.

* * * * *